United States Patent [19]

Pomroy

[11] 3,948,474

[45] Apr. 6, 1976

[54] DEVICE FOR COLLECTING AND STORING TUMBLERS, LITTER AND THE LIKE

[75] Inventor: James F. Pomroy, St. Paul, Minn.

[73] Assignee: Plastics, Inc., St. Paul, Minn.

[22] Filed: Dec. 23, 1974

[21] Appl. No.: 535,303

[52] U.S. Cl. ..... 248/99; 224/48 R

[51] Int. Cl.[2] ..... B65B 67/04

[58] Field of Search .... 224/45 H, 48 R, 46 T, 48 C; 248/99, 100; 108/25, 26

[56] References Cited

UNITED STATES PATENTS

| | | | |
|---|---|---|---|
| 1,353,866 | 9/1920 | Vondree | 108/25 |
| 1,359,586 | 11/1920 | Flagg | 248/100 |
| 2,080,865 | 5/1937 | Lassiter | 108/25 |
| 2,625,973 | 1/1953 | Weldon et al. | 248/99 |
| 2,771,232 | 11/1956 | Reed | 224/48 C |
| 3,105,665 | 10/1963 | Starkweather | 108/26 |
| 3,181,483 | 5/1965 | De Vitt et al. | 108/25 |
| 3,240,457 | 3/1966 | Backland et al. | 248/99 |
| 3,768,763 | 10/1973 | Hembree | 248/99 |
| 3,847,332 | 11/1974 | Murai | 248/99 |
| 3,848,841 | 11/1974 | Rafeldt | 248/99 |

FOREIGN PATENTS OR APPLICATIONS

| | | | |
|---|---|---|---|
| 1,112,590 | 10/1954 | France | 224/46 T |

*Primary Examiner*—Robert J. Spar
*Assistant Examiner*—Kenneth Noland
*Attorney, Agent, or Firm*—Wicks & Nemer

[57] ABSTRACT

A device for collecting and storing tumblers, litter and the like including a flat support formed with a recess extending thereinto from the edge thereof to allow the users hand to hold the support substantially centrally thereof together with openings formed in the support adjacent the recess for holding nested tumblers and a further opening through which litter may be passed into the bag, the bag removably attached to the edge of the support and depending from the support in full open condition.

2 Claims, 5 Drawing Figures

DEVICE FOR COLLECTING AND STORING TUMBLERS, LITTER AND THE LIKE

SUMMARY

The invention relates to a device for collecting storing tumblers, litter and the like with particular use in the airline industry. In the serving of cocktails in tumblers aboard an airplane there is, in many crowded flights, the problem of gathering up a great number of tumblers, napkins and light garbage in a minimum of time by a stewardess. With present day collection of tumblers in a bag, same rarely nest so that the total volume required for storage is often times greater than the waste capacity of the galley of the airplane, and space is at a premium on an airplane.

The present device includes a flat support member having a recess extending into the support whereby the fingers may be placed under the support with the thumb on top substantially at the center thereof for adequate holding of the device either in an empty or full condition.

The support is also formed with openings adjacent the recess in each of which tumblers may be nested and the suppport is formed with a further opening through which litter and the like may be passed into a bag removably connected to and depending from the support. With the bag readily available the litter of a tumbler may be disposed of so that the tumbler may be nested with other tumblers thereby greatly decreasing the volume of space required for such storage. With the present invention it has been found that at least 20 tumblers may be nested in each opening of the support.

Tumblers not desired to be stacked in the openings may also be passed through the last mentioned opening together with napkins, light garbage and the like. With the items in the bag, the bag may be simply removed from the support, tied up and disposed of. Thus, with the present invention a relatively great number of tumblers and litter may be easily and quickly gathered and stored in a minimum of space.

Referring to the drawings forming part of this application:

Figure 2:
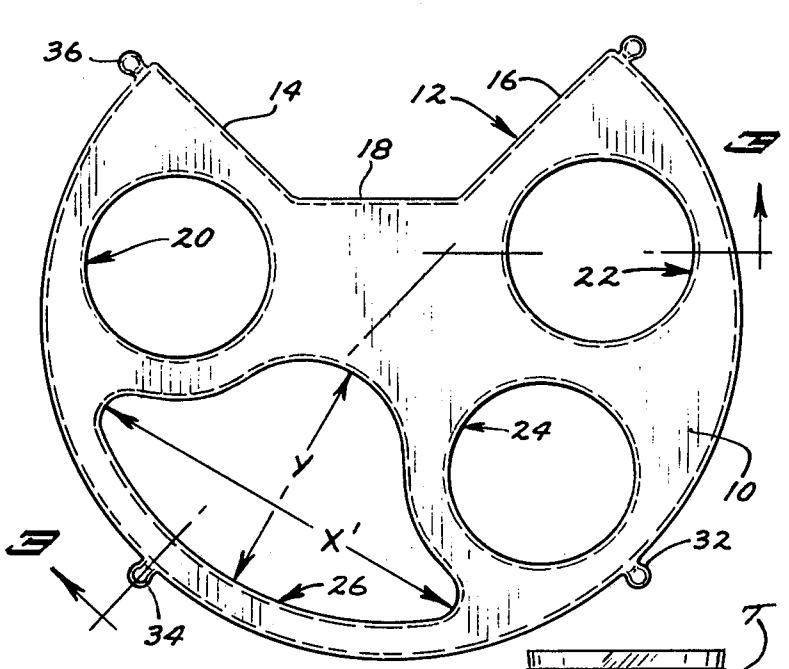
FIG. 2 is a top plan view of the support top.
Figure 3:
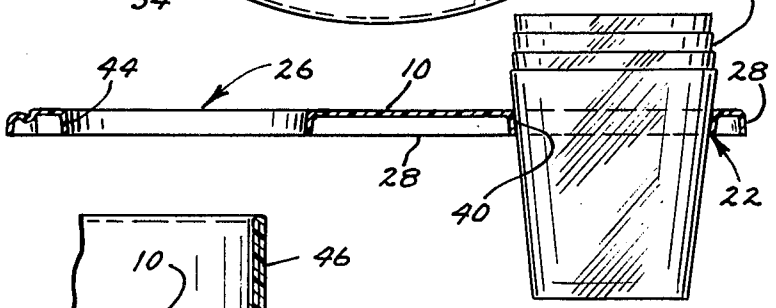
FIG. 3 is a sectional view of the line 3—3 of FIG. 2 with tumblers stacked in one of the openings.
Figure 5:
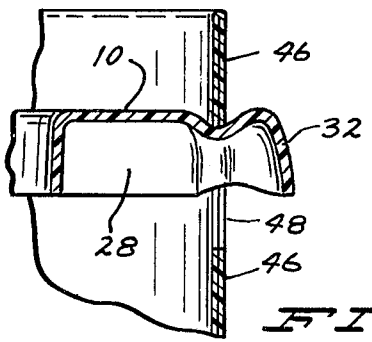
FIG. 5 is a sectional view on the line 5—5 of FIG. 1.
Figure 1:
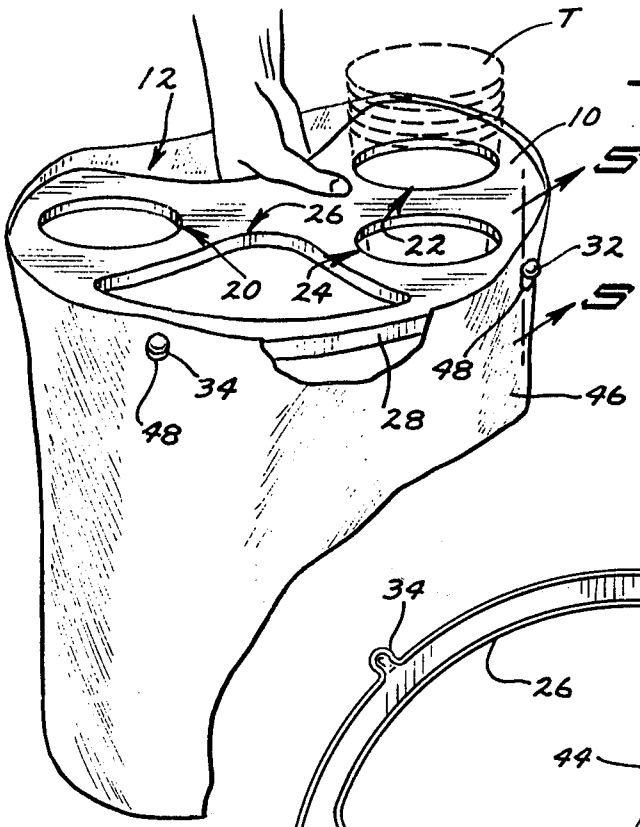
FIG. 1 is a perspective view of a device for storing tumblers, litter and the like embodying the invention, a portion of the bag member thereof being cut away with tumblers stacked in one of the openings.
Figure 4:
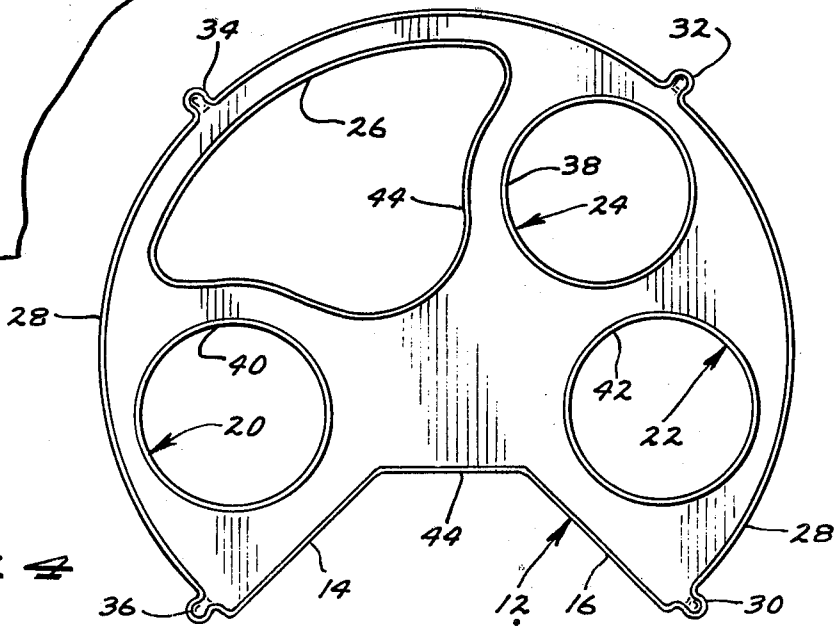
FIG. 4 is a bottom plan view of the support top.

Referring to the drawings in detail, the device for storing tumblers, litter and the like A includes the flat support 10. The support 10 includes the cutout portion in the form of a recess 12 extending inwardly into the flat support 10. The cutout portion 12 includes the spaced side edges 14 and 16 which converge from the edge of the support inwardly to the end edge 18, thereby forming a hand access to the central part of the support. As illustrated in FIG. 1, the cutout 12 allows an operator to place his fingers under substantially the center of the support thereby providing adequate support and balance of the device with the hand.

The support 10 is also formed with the circular openings 20, 22 and 24, with opening 20 positioned closely adjacent both the side edge 14 of the cutout and the outer edge of the support. Similarly, the opening 22 is positioned closely adjacent the side edge 16 of the cutout 12 and the outer edge of the support 10. The circular opening 24 is positioned closely adjacent the edge of the support and the opening 22. With such positioning of the openings 20, 22 and 24 it leaves sufficient area of the flat support centrally thereof for engagement by the fingers of the user, particularly FIG. 1.

The numeral 26 designates a further opening formed in the support, the use of which will be set forth hereinafter. The opening 26 has a major horizontal dimension as at "X" and a minor horizontal dimension as at "Y". The opening is somewhat bell-shaped and is positioned substantially centrally between the openings 20 and 24. The support 10 is formed at the edge thereof with the depending flange 28, and extending outwardly from the flange 28 are the spaced projections 30, 32 and 34 and 36 which are molded integrally with the flange 28.

Each of the openings 20, 22, 24, and 26 is formed with the peripheral depending flange 38, 40, 42, and 44, respectively, which taper slightly inwardly of the opening. Further provided is the plastic bag 46 which has formed in the wall thereof and adjacent the upper edge the holes 48 which are spaced to correspond with and receive the projections 30, 32, 34, and 36 thereby removably mounting the bag in full open condition below the support 10 and the openings thereof.

In using the device A the bag 46 is attached to the support 10 by engaging the projections 30–36 in the holes 48 of the bag in the position illustrated in FIG. 1. The device A is held by placing the hand within the cutout or recess 12 with the fingers under support 10 and the thumb on top of the support as illustrated in FIG. 1. Tumblers T may be stacked in the openings 20, 22, and 24, or if the tumblers are undesirably covered with a foreign substance or stuffed with napkins and not amenable to stacking in the openings 20, 22 and 24, tumblers may be deposited in the bag by inserting the same through the opening 26. The opening 26 due to its major and minor dimensions can receive a variety of differently sized and shaped objects including items left in the tumblers. Napkins and various other forms of trash may be deposited in the bag 46 through the opening 26.

I claim:

1. A device for collecting, storing and carrying tumblers, litter and the like comprising:

a. a continuous planar flat support having b. a hand receiving recess extending inwardly from the edge of the flat support adapted for positioning of the user's hand within the recess with the fingers thereof under the support and within the bag substantially centrally thereof to thereby allow a balancing of the support on the user's fingers.

c. at least one opening formed in said support to engage the wall of a tumbler inserted partially through the opening and allow further tumblers to be stacked in said first mentioned tumbler, d. a bag, e. a further opening formed in said support and spaced from said recess and said opening for the depositing of litter through said further opening and into the bag, and f. means for removably attaching said bag to the periphery of the support and across and outer extremities of the hand receiving recess for receiving items passed through said further opening.

2. The device of claim 1 further characterized by said support having a second opening formed therein adapted to engage the wall of a tumbler and substantially opposite to said first mentioned opening to balance the support when said one opening and said second opening have tumblers therein.

* * * * *